United States Patent [19]

Aiuola et al.

[11] Patent Number: 4,944,138

[45] Date of Patent: Jul. 31, 1990

[54] APPARATUS FOR GROUPING BAGS DISPENSED BY AN AUTOMATIC DEVICE

[75] Inventors: Franco Aiuola, Bologna; Renato Piccinini, Sala Bolognese, both of Italy

[73] Assignee: Azionaria Costruzioni Macchine Automatiche A.C.M.A. S.p.A., Bologna, Italy

[21] Appl. No.: 189,441

[22] Filed: May 2, 1988

[30] Foreign Application Priority Data

May 13, 1987 [IT] Italy ..... 3478 A/87

[51] Int. Cl.[5] ..... B65B 35/40; B65B 39/14

[52] U.S. Cl. ..... 53/540; 53/247; 53/252; 414/790.4; 414/794.7

[58] Field of Search ..... 53/153, 247, 252, 447, 53/534, 539, 540; 198/468.8; 271/188, 209; 414/47, 89, 790.3, 790.4, 794.7

[56] References Cited

U.S. PATENT DOCUMENTS

| | | | |
|---|---|---|---|
| 2,698,692 | 1/1955 | Jones et al. | 414/47 |
| 3,180,066 | 4/1965 | Mahaffy et al. | 53/247 X |
| 3,479,795 | 11/1969 | Martin | 53/540 |
| 3,593,837 | 7/1971 | Loomis | 53/540 X |
| 3,822,008 | 7/1974 | Benner, Jr. et al. | 414/47 X |
| 3,959,951 | 6/1976 | Paules | 414/47 X |
| 4,709,535 | 12/1987 | Mahaffy et al. | 53/247 X |
| 4,800,703 | 1/1989 | Goodman | 53/247 X |

*Primary Examiner*—Robert J. Spar
*Assistant Examiner*—Janice Krizek
*Attorney, Agent, or Firm*—Guido Modiano; Albert Josif

[57] ABSTRACT

The apparatus arranges in groups bags, dispensed by an automatic device, arranged one next to the other, and resting on a common same plane. The apparatus comprises a reception station for the bags dispensed by the device superimposed on one another. A conveyor with successive seats moves intermittently below the station, and a multiple expeller intersects the station to introduce the bags contained therein into corresponding housings of the conveyor. Selective control members for the control of said conveyor and of said expeller adapted to establish a correspondence between stepwise advancements of the conveyor seats thereof filled with groups of a preset number of bags.

3 Claims, 2 Drawing Sheets

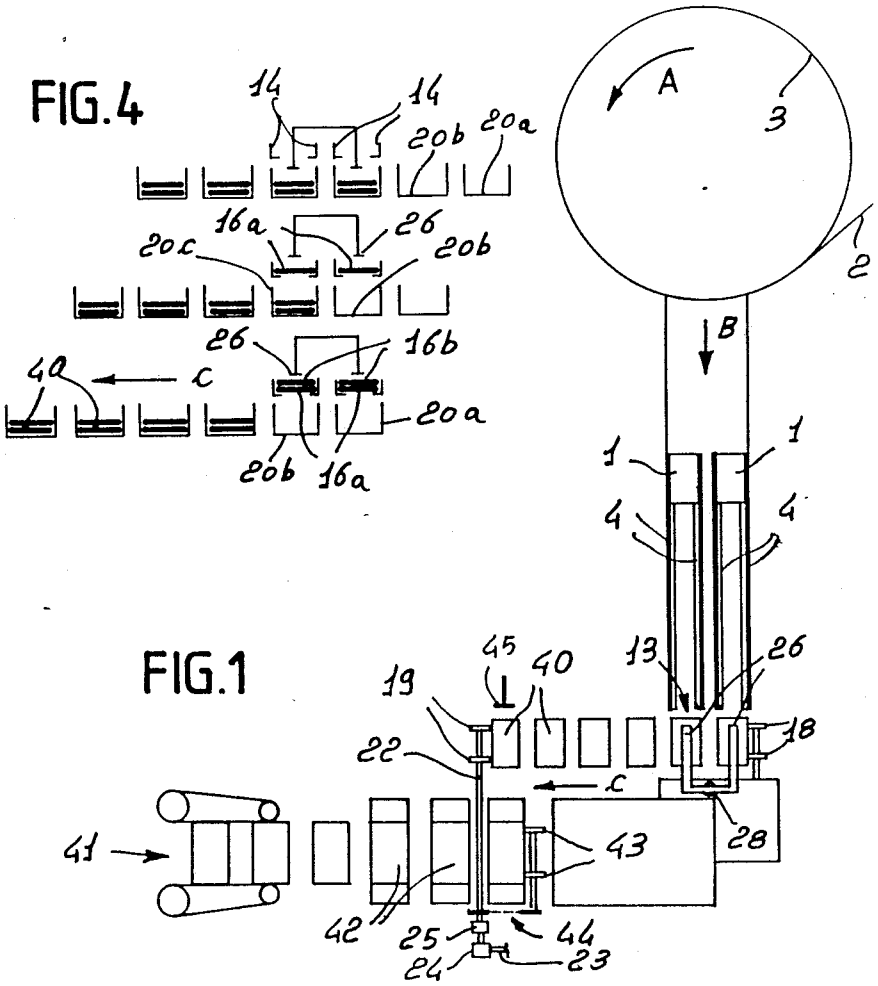
FIG.1
FIG.4
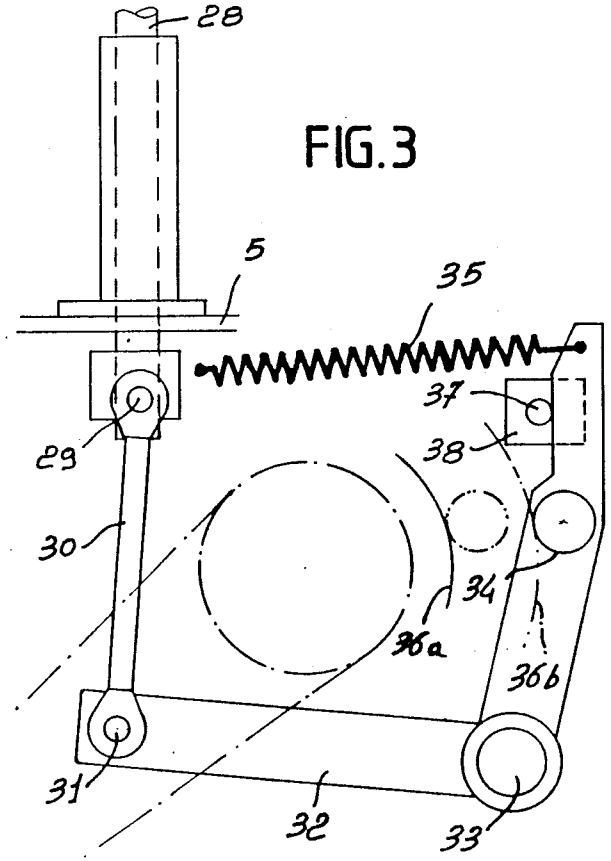
FIG.3

APPARATUS FOR GROUPING BAGS DISPENSED BY AN AUTOMATIC DEVICE

BACKGROUND OF THE INVENTION

The present invention relates to an apparatus which groups together bags dispensed by an automatic device, in particular for packaging the bags, and arranges them in groups to be boxed. Automatic packaging devices exist which obtain bags starting from a band of sheet material, in practice of the heat-sealable type, and are finally closed after filling them with the respective products. Usually two bags exit separately at present intervals from a device of this type and are dispensed one next to the other on a common rest plane.

Currently it generally occurs that the two bags dispensed each time reach a station at which respective expellers operate. The expellers, acting in appropriate phases with respect to each other, introduce the two bags into underlying continuous-motion transport means. The transport means extend parallel to the direction along which the two bags are mutually adjacent, and cause the advancement of the various bags, arranged one behind the other and mutually spaced, by entraining them with appropriate teeth. The bags are thus made to fall into one and then into the other of two seats of a tray-like receptacle, which alternates between two positions. At one of said positions the bags are superimposed on one another and form a group within a respective seat of the tray which, in moving to its other position, becomes interposed between a respective pusher and an intermittent motion conveyor with successive housings. Thus, at each stop of the conveyor, the two pushers mutually intersect the respective seats to transfer the group of bags prreviously arranged therein, into housings of said conveyor. Immediately downstream of said tray all the housings of the conveyor thus contain a group of bags, which is then extracted from the conveyor, again during a stop thereof, and is sent to be boxed.

The devices described above and heretofore used to group bags are considerably bulky and complicated and subject the bags to an excessive number of manipulations.

SUMMARY OF THE INVENTION

The aim of the present invention is therefore to provide an apparatus for grouping bags dispensed by an automatic device which prearranges bags, dispensed filled and closed by an automatic device, in groups of a desired number, and which has reduced dimensions and complexity, and limits the operations performed on the bags to an indispensable minimum.

Within this aim, an object of the invention is to provide an apparatus for grouping bags dispensed by an automatic device which is extremely reliable in operation, economically advantageous in construction and use, and easily adaptable to variations of the number of bags composing the groups.

The aim and the object described above are achieved by the apparatus according to the invention for grouping bags dispensed by an automatic device, said apparatus being characteristized in that it comprises a station for the reception of bags dispensed by said device and superimposed in the same station, a conveyor having successive housings and which is adapted for intermittent advancement and passes below said station, a multiple expeller adapted to intersect said station to introduce the bags contained therein in corresponding housings of said conveyor, selective control means for the control of said conveyor and said expeller adapted to establish a correspondence between advancements of the conveyor and housings thereof filled with groups of a preset number of bags, introduced by said expeller, elements for the extraction of groups of bags from said conveyor and for transporting said bags to be boxed and cooperating with the conveyor downstream of said station.

BRIEF DESCRIPTION OF THE DRAWINGS

The details will become apparent from the detailed description of a preferred embodiment of the bag grouping apparatus according to the invention, illustrated only by way of non-limitative example in the accompanying drawings, wherein:

FIG. 1 is a schematic plan view of the apparatus;

FIG. 3 is an elevation view of a detail of said selective means;

FIG. 4 is a schematic view of three successive steps of operation of the apparatus.

DESCRIPTION OF THE PREFERRED EMBODIMENTS

Figure 2:
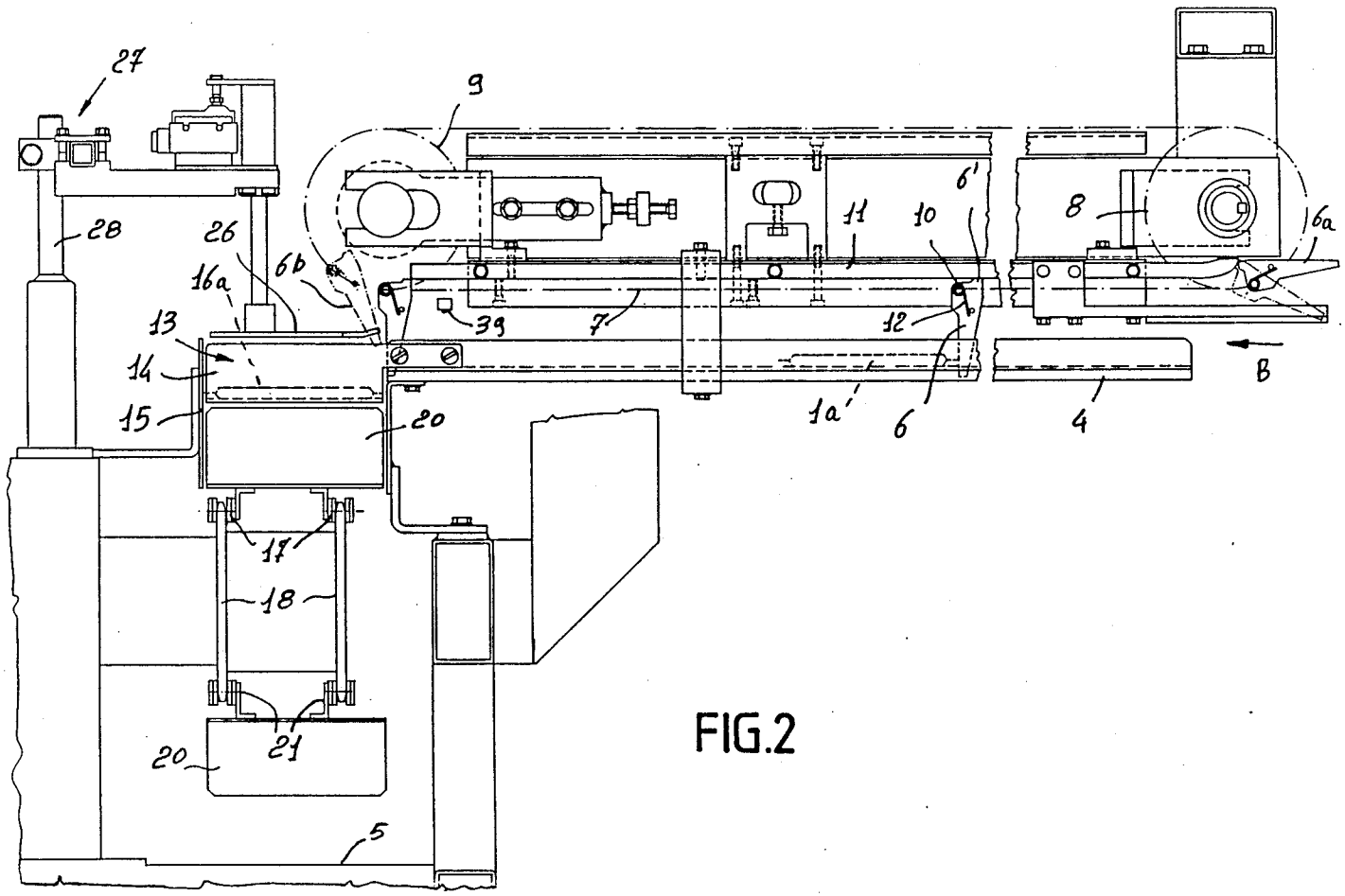
FIG. 2 is a partially cut-away elevation view thereof.

With particular reference to FIG. 1, the reference numeral 1 indicates the bags, which are dispensed, usually in pairs, by a known automatic device, which substantially performs their filling. In the device the bags are obtained starting from a band 2 of flexible sheet material, expendiently of the heat-sealable type, and advantageously folded longitudinally and provided with transverse weldings, thus defining bags thereon. Once two bags are detached from the band 2, said bags pass into a carousel 3, which along a path A fills them with related products and completes their closure. Again in a known manner, at the exit from the carousel 3 the bags pass from a vertical to a horizontal position and are dispensed according to the arrow B separate from one another and mutually adjacent.

Again according to the arrow B, the bags, now indicated at 1*a* (FIG. 2), are entrained so as to slide above and along respective pairs of angular guides 4, which are supported at a stationary position by the frame 5 of the apparatus which will be described hereinafter. Teeth 6, distributed along closed-loop chains 7, are arranged above the guides 4 and adapted to entrain the bags. The chains engage the toothed wheels 8 and 9 and their lower branches are adapted for continuous movement in the direction B, the teeth 6 being caused to move appropriately in phase with respect to the bags progressively dispensed by the carousel 3. By means of a respective pivot 10, each tooth 6 is mounted oscillably on the chains 7. At said lower branches, a lug 6' of each tooth 6 is engaged by a stationary cam 11 which extends in a direction substantially parallel to said branches. Respective torsion springs 12 bias the teeth 6 towards a position of engagement whereat they intersect the guides 4. It should be noted that the condition of a tooth 6, which is about to move from an inactive position to an active position in engagement with the cam 11, is illustrated at 6*a*, while 6*b* illustrates the idle condition of a tooth 6 which has just moved from an active or engagement position to an idle or inactive condition. Upon being released from the teeth 6, the bags drop into a reception station 13, which in practice is defined by pairs of angular elements 14, supported by frame 5 in such a manner as to substantially define continuation of the guides 4 and which provide support for the bags at a level lower than said guides 4. The station 13 also defines a front member 15. After a first batch of bags 16*a* (in the illustrated example two bags) has been dispensed by the carousel 3 and have been entrained along the guides 4 by the teeth 6 to reach the station 13 (FIG. 2 and diagram on the second line of FIG. 4), the apparatus can cause other batches of bags dispensed successively by the carousel to also reach the station 13, before the first batch of bags 16*a* have been expelled therefrom, as will become apparent hereinafter. Thus it occurs that the successive batches of bags are superimposed on the first batch of bags 16*a*. It may in any case be convenient that only one other successive batch of bags 16*b* (diagram on the third line of FIG. 4) are superimposed on the first batch of bags 16*a* to thus form two groups constituted by only one pair of bags each in the station 13.

Below the station 13 there passes a conveyor with successively arranged housings. In practice, the conveyor advantageously comprises a pair of closed-loop chains 17, which engage toothed wheels 18, 19. The upper branches of the chains 17 extend substantially parallel to the direction along which the bags dispensed by the carousel 3 are arranged adjacent to one another, and are caused to move with an intermittent motion in the direction of the arrow C. Elements 20 are distributed along the chain 17 and have the same distance from one another as the bags have in the station 13. In the longitudinal plane of the conveyor 17–20 said elements have a U-shaped cross section (FIG. 4), the arms of the U being directed towards the outside of the conveyor. Each element 20, defining one of said housings, is carried by the chains 17 by means of right-angle elements 21. The drive wheels 19 of the conveyor are keyed to a shaft 22 which receives its motion from the shaft 23 through an intermittent movement device 24 and a coupling 25, both of a known type. It should be noted that by disconnecting the coupling 25, per se adapted to maintain the shafts 22 and 23 in phase, the stops of the conveyor 17–20 are prolonged. With the coupling connected, the chains 17 are driven so as to cause the conveyor to perform the advancement by one housing 20 at a time.

A multiple expeller, which in practice downwardly terminates in two active parts or pusher parts 26 arranged protrudingly, is intended to intersect therewith the station 13 and precisely to pass, with alternating motion, between the respective pairs of right-angle elements 14 (first line of FIG. 4). Under the action of the active parts 26, the bags contained in the station 13 are forced to deform so as to pass beyond the right-angle elements 14 and to enter in corresponding housing 20 of the conveyor which is simultaneously at rest. Naturally, while the bags 1*a* reach the station 13, active parts 26 are instead arranged overlying said station (FIG. 2, second and third lines of FIG. 4). The active parts 26 are part of a spatial frame, which is rigidly associated above and at a certain distance from the station 13, at a location 27, with the top of a substantially vertical stem 28, protruding from the frame 5 and slideably guided therein. To the base 29 of said stem 28 there is articulated the first end of a connecting rod 30 (FIG. 3), articulated at its second end 31 to one of the arms of a lever 32, which is oscillably carried by the frame 5 at a pivot 33 and has the other arm provided with a small roller 34. Spring return means 35, extending between a point of the frame 5 and an arm of the lever 32, bias the roller 34 into engagement with a cyclic control cam 36*a*, 36*b*. When the roller 34 engages the smaller radius portion 36*a* of the cam, the connecting-rod mechanism 30–31 is in the condition in which the expeller intersects the station 13. When instead the roller 34 engages the greater radius portion 36*b* of the cam, the expeller is in a raised position. The expeller may be locked in said raised position when an arm of the lever 32 finds a stop, as illustrated in FIG. 3, at a removable abutment 37. In practice said abutment can be provided with the keeper of an electromagnet 38, said keeper establishing the abutment, in one of the states of the electromagnet, and excluding it in the other state.

As already mentioned, both by establishing the abutment 37 and by disconnecting the coupling 25, the control of the expeller 26 and of the conveyor 17–20 can be effected selectively. By using the selective control means, it is possible to have a plurality of advancements of the conveyor corresponding to the filling of the same number of successive housings thereof with a present number of bags. Reference should initially be made to FIG. 4, which relates to the instance in which respective groups of one pair of bags are arranged in the housing 20. Once the introduction of a pair of bags in two housings 20 has occurred, the two bags 16*a* reach the station 13 and in the meantime the conveyor advances by one step, so that below the station there remain a full housing 20*c* and an empty housing 20*b*. The bags 16*b* then reach the station and superimpose on the first bags 16*a*, and in the meantime the conveyor advances by a second step, so that the housings 20*b* and 20*a*, both empty, are below the station. At this point the expeller 26 may again descend to fill both the housings 20*b* and 20*a*. To have groups of a number of bags greater than two in these housings, it would be sufficient to keep the conveyor at rest and continue to have the expeller descend every time that bags 16 reach the station 13 and until the moment in which the desired number of bags is reached in the housings. Such a number, greater than two, may naturally be odd or even. It should be noted that upstream of the station 13 photocell sensors 39 detect if in each instance bags do arrive at the appropriate rate at the same station; naturally the coupling 25 is also under the control of these sensors, in order to prevent any advancement of the conveyor if the housings thereof have not received the desired number of bags.

Downstream of the station 13, with the conveyor 17–20 there cooperate elements which extract from the seats thereof the groups of bags 40 contained therein to transport them, for instance, to be boxed. For example, a second conveyor with successive housings is provided, generally indicated at 41, which extends parallel to the first and which, with its inlet, is located next to the exit of said conveyor 17–20. In a known manner the housings of the conveyor 41 are fed with respective containers 42, open towards the housings 20 of the first conveyor. The toothed wheels 43, driving the second conveyor, receive their motion from a transmission 44, which is driven by the shaft 22 after the devices 24 and 25. The two conveyors being simultaneously at rest, a reciprocating pusher 45 intersects a housing of the first conveyor and transfers therefrom the group of bags 40 into the container 42, which is located in the oppositely arranged housing of the conveyor 41. With the successive advancements of the second conveyor, the containers 42 are then closed in a known manner.

We claim:

1. Apparatus for grouping bags dispensed by an automatic device, comprising:

a station for receiving bags dispensed by said automatic device in a stack formed of a selected number of bags;

a conveyor having successive housings and adapted to move step by step below said station, said step corresponding to the distance between two adjacent housings of said conveyor, said housings being adapted to receive said bags from said station;

means for extracting said stacks of said bags from said conveyor housings and means for packing said stacks;

said station defining at least two seats, said seats being disposed side by side at a distance equal to said distance between two adjacent housings of said conveyor, each of said seats being arranged over one of said conveyor housings in order that said at least two seats are respectively arranged over two of said housings when said conveyor is not moving;

an expeller adapted to eject said stacks of bags from said station and to introduce said stacks into said conveyor housings;

control means adapted to operate said expeller synchronously with said conveyor in order that when a preset number of said bags filled each of said seats to form said stack, an empty housing of said conveyor is arranged below each of said seats; said expeller being subsequently operated to fill each of said empty housings with a respective one of said stacks; said conveyor being subsequently operated to move forward by a preset number of steps until said housings filled with said stacks are moved beyond said station and successive empty conveyor housings are disposed below respective ones of said seats of said station; while said conveyor is being moved forward by said preset number of steps, said seats of said station are being filled with said preset number of bags, said preset number of steps corresponding to said preset number of bags forming each of said stacks; said expeller being subsequently operated to fill and empty conveyor housings with said stacks of bags, wherein each of said station seats comprises a pair of angular elements, each of said angular elements having a side portion and a bottom portion, said bottom portion of each of said pair of said angular elements being disposed face to face, a middle open portion being defined by said bottom portions of said pair of angular elements, said bottom portions of said angular elements being adapted to support at least one of said bags; said expeller comprising a pusher part adapted to insert into said open portion in order to push said bag stack through said open portion to eject said bag stack from said station and to introduce said stack into one end of said conveyor housings.

2. Apparatus for grouping bags dispensed by an automatic device, comprising:

a station for receiving bags dispensed by said automatic device in a stack formed by a selected number of bags;

a conveyor having successive housings and adapted to move step by step below said station, said step corresponding to the distance between two adjacent housings of said conveyor, said housings being adapted to receive said bags from said station;

means for extracting said stacks of said bags from said conveyor housings and means for packing said stacks;

said station defining at least two seats, said seats being arranged side by side at a distance equal to said distance between two adjacent housings of said conveyor, each of said seats being arranged over one of said conveyor housings in order that said at least two seats are respectively arranged over two of said housings when said conveyor is not moving;

an expeller adapted to eject said stacks of bags from said station and to introduce said stacks into said conveyor housings; said expeller having a raised inactive position and an active position, said expeller comprising a pusher part, in said active position said pusher part being adapted to eject said bag stack from said station and to introduce said stack into one of said conveyor housings;

control means adapted to operate said expeller synchronously with said conveyor;

said control means comprising a connecting-rod mechanism having a cyclic control cam, a lever, a connecting rod and a stem; said stem being connected to said pusher part and being activated by said connecting rod, said connecting rod being operated by said lever, said lever being pivoted to a frame and having a roller or cam follower, said roller being biased by a spring means in sliding contact with said control cam, said frame having an abutment member adapted to engage said lever, said control cam having a smaller radius portion and a greater radius portion, said smaller radius portion defining a position of said lever corresponding to said active position of said expeller, said greater radius portion defining a position of said lever corresponding to said inactive raised position of said expeller, said abutment member being selectively activated to engage said lever to lock said expeller in said raised position;

said control means operating said expeller synchronously with said conveyor in order that when a preset number of said bags has filled each of said seats to form said stack, an empty housing of said conveyor is arranged below each of said seats; said expeller being subsequently operated to fill each of said empty housings with a respective one of said stacks; said conveyor being subsequently operated to move forward by a preset number of steps until said housings filled with said stacks are moved beyond said station and successive empty housings of said conveyor are arranged below respective ones of said seats of said station; while said conveyor is being moved forward by said preset number of steps, said seats of said station are being filled with said preset number of bags, said preset number of steps corresponding to said preset number of bags forming each of said stacks; said expeller being subsequently operated to fill said empty conveyor housings with said stacks of bags.

3. Apparatus for grouping bags dispensed by an automatic device, comprising:

a station for receiving bags dispensed by said automatic device in a stack formed of a selected number of bags;

a conveyor having successive housings and adapted to move step by step below said station, said step corresponding to the distance between two adjacent housings of said conveyor, said housings being adapted to receive said bags from said station;

means for extracting said stacks of said bags from said conveyor housings and means for packing said stacks;

said station defining at least two seats, said seats being arranged side by side at a distance equal to said distance between two adjacent housings of said conveyor, each of said seats being arranged over one of said conveyor housings in order that said at least two seats are disposed respectively over two of said housings when said conveyor is not moving;

an expeller adapted to eject said stacks of bags from said station and to introduce stacks into said conveyor housings; each of said seats of said station comprising a pair of angular elements, each of said angular elements having a side portion and a bottom portion, said bottom portion of each of said pair of said angular elements being arranged face to face, a middle open portion being defined by said bottom portions of said pair of angular elements, said bottom portions of said angular elements being adapted to support at least one of said bags;

said expeller having a raised inactive position and an active position, said expeller comprising a pusher part, in said active position said pusher part being adapted to insert into said open portion in order to push said bag stack through said open portion to eject said bag stack from said station and to introduce said stack into one of said conveyor housings;

control means adapted to operate said expeller synchronously with said conveyor;

said control means comprising a connecting-rod mechanism having a cyclic control cam, a lever, a connecting rod and a stem; said stem being connected to said pusher part and being activated by said connecting rod, said connecting rod being operated by said lever, said lever being pivoted to a frame and having a roller or cam follower, said roller being biased by a spring means in sliding contact with said control cam, said frame having an abutment member adapted to engage said lever, said control cam having a smaller radius portion and a greater radius portion, said smaller radius portion defining a position of said lever corresponding to said active position of said expeller, said greater radius portion defining a position of said lever corresponding to said inactive raised position of said expeller, said abutment member being selectively activated to engage said lever to lock said expeller in said raised position;

said control means operating said expeller synchronously with said conveyor in order that when a preset number of said bags has filled each of said seats to form said stack, an empty housing of said conveyor is arranged below each of said seats; said expeller being subsequently operated to fill each of said empty housings with a respective one of said stacks; said conveyor being subsequently operated to move forward by a preset number of steps until said housings filled with said stacks are moved beyond said station and successive empty conveyor housings are arranged below respective ones of said seats of said station; while said conveyor is being moved forward by said preset number of steps, said seats of said station are being filled with said preset number of bags, said preset number of steps corresponding to said preset number of bags forming each of said stacks; said expeller being subsequently operated to fill said empty conveyor housings with said stacks of bags.

* * * * *